US005833588A

United States Patent [19]

Connelly III et al.

[11] Patent Number: 5,833,588

[45] Date of Patent: Nov. 10, 1998

[54] HAND-HELD RESILIENT EXERCISER

[76] Inventors: William L. Connelly III, 1650 Northern Ave., Kingman, Ariz. 86401; Todd M. Grimm, 21628 N. 2nd Ave., Phoenix, Ariz. 85027

[21] Appl. No.: 676,449

[22] Filed: Jul. 8, 1996

[51] Int. Cl.[6] ..... A63B 21/02

[52] U.S. Cl. ..... 482/126; 482/121; 482/122

[58] Field of Search ..... 482/26, 27, 29, 482/30, 31, 32, 92, 121, 122, 126, 123, 124, 129, 130, 139, 49; 446/486, 490

[56] References Cited

U.S. PATENT DOCUMENTS

| | | | |
|---|---|---|---|
| D. 350,997 | 9/1994 | Connelly, III . | |
| 3,051,482 | 8/1962 | Harpham | 482/124 |
| 3,532,340 | 10/1970 | Nardiello | 482/124 |
| 3,759,514 | 9/1973 | Cox | 482/126 |
| 4,451,035 | 5/1984 | Manzi | 482/126 |
| 5,016,874 | 5/1991 | Boardman | 482/126 |
| 5,395,296 | 3/1995 | Webster et al. | 482/130 |

FOREIGN PATENT DOCUMENTS

| | | | |
|---|---|---|---|
| 206592A | 12/1986 | European Pat. Off. | 482/49 |
| 1775446 | 12/1969 | United Kingdom | 482/126 |

*Primary Examiner*—Richard J. Apley
*Assistant Examiner*—William LaMarca
*Attorney, Agent, or Firm*—H. Dennis Kelly; Timmons & Kelly

[57] ABSTRACT

A set of elastic bands are partially enclosed in an annular frame. A handle portion of each band extends outside the frame and is covered by a slip-on handle. An anchoring portion of the band is located on either side of the handle portion. Anchor posts and clamps attach the anchoring portions to the frame. The band handle portions and associated handles are disposed in opposed pairs, one pair by the outer edge of the frame, and the other pair by the inner edge of the frame. The frame defines struts, offset from and parallel to each handle, that can act as additional gripping surfaces.

9 Claims, 2 Drawing Sheets

HAND-HELD RESILIENT EXERCISER

BACKGROUND OF THE INVENTION

1. Field of the Invention

This invention relates in general to exercise equipment, and in particular to a device for exercising muscles throughout the body.

2. Description of the Related Art

Traditional exercise devices, such as free weights, dumbbells, and hand grips, are generally only useful for exercising limited areas of the body and thus cannot provide a rounded exercise regimen. A number of different structures have been devised for exercising the entire body. These devices are typically so large and heavy that they must be permanently installed in a fixed location. An exercise apparatus that is lightweight and portable while still providing a well rounded workout for the entire body would be a desirable improvement over the known art. An exercise apparatus that is aesthetically appealing would also be desirable. As always, a exercise apparatus that is less expensive is also desirable.

SUMMARY OF THE INVENTION

The general object of the invention is to strengthen the muscles throughout the body by providing resistance to movement of the elements in the device. Another object of the invention is that it be lightweight and portable. A third object is that the device have a pleasing appearance.

In general, these objects are achieved by a two-piece annular frame that partly encloses a set of elastic bands that provide resistance to being stretched. A handle portion of each band extends outside the frame and, together with slip-on handles, provide hand grips for the user. The handles are arranged in opposed pairs, one pair located by the outer edge of the frame, and one pair by the inner edge of the frame. The frame defines a strut offset from and parallel to each handle for use as an additional gripping surface during use. The device is operated by grasping a combination of the handles and the struts, depending on the particular exercise to be performed, and attempting to displace the handle away from its associated strut. The frame is made of rugged, lightweight plastic, and can be made in attractive colors and surface patterns. The device is portable, and can be carried by gripping a strut in the same manner as carrying a suitcase.

The above, as well as additional objects, features, and advantages of the invention will become apparent in the following detailed description and in the drawings.

DESCRIPTION OF THE PREFERRED EMBODIMENT

Figure 1:
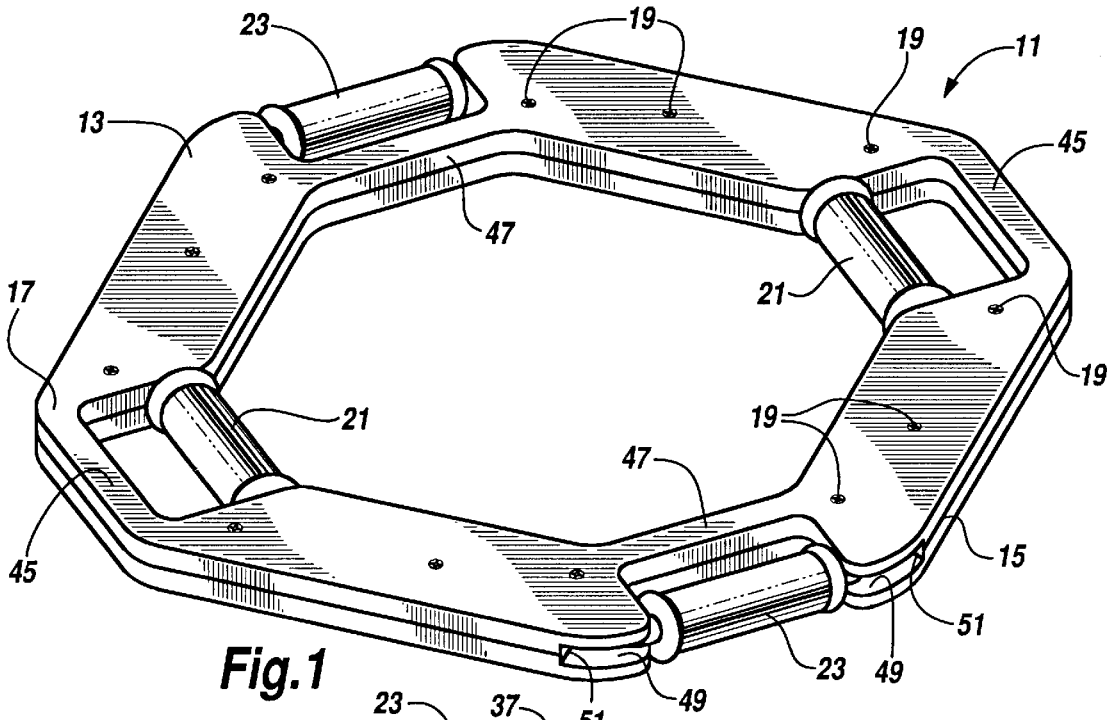
FIG. 1 is a perspective view of an exercise apparatus according to the invention.

FIG. 1 shows the preferred embodiment of the exercise apparatus 11 of the invention when fully assembled. The exercise apparatus 11 includes a frame 13 made of acrylonitrile-butadiene-styrene (ABS) plastic, or any material having equivalent or better impact resistance, strength, and durability. The frame 13 has a first half 15 and a second half 17 fastened together with bolts 19 or equivalent fasteners so that the halves 15 and 17 can be disassembled. The frame 13 is annular, and is shaped substantially like a flattened octagon with unequal sides, wherein each pair of opposed sides have equal length. The dimensions and configuration are not critical, although the frame 13 should be large enough to permit a user's head to pass through the frame 13 with enough clearance for the user to grab a pair of inner handles 21 comfortably.

A pair of inner handles 21 and an identical pair of outer handles 23 are located on alternate sides of the frame 13. The inner handles 21 are located opposite each other along the inner perimeter of the frame 13, while the outer handles 23 are located along the outer perimeter of the frame 13, at right angles to the first pair 21. The handles 21 and 23 can have a contoured, rubberized grip area to ensure that they can be gripped firmly during use without slipping. The handles 21 and 23 slip onto elastic bands, as discussed below. In the following discussion, the elements associated with each handle 21 and 23 are considered identical to their respective elements for the other handle 21 and 23 in each pair, and will be referenced with the same numbers.

Figure 2:
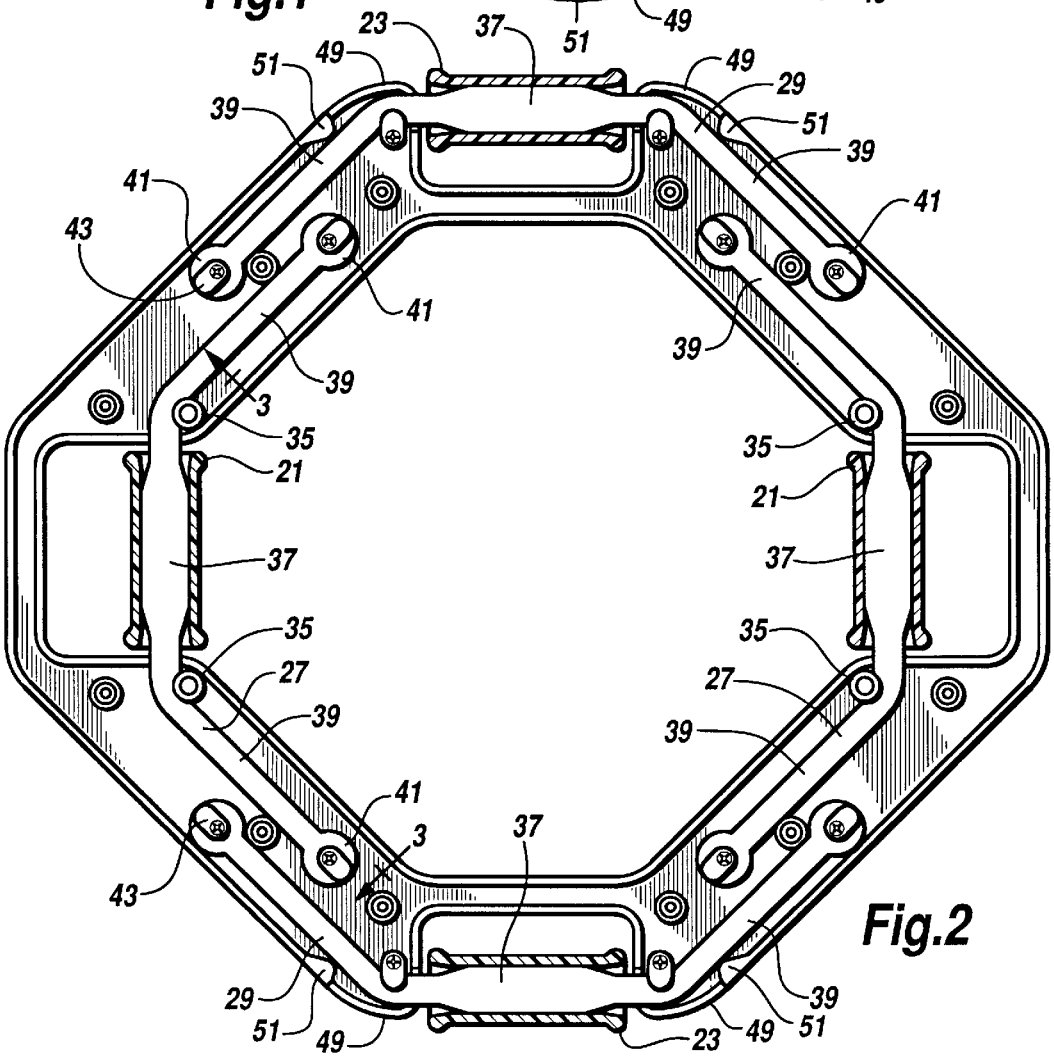
FIG. 2 is a top plan view thereof, with the top half removed.
Figure 3:
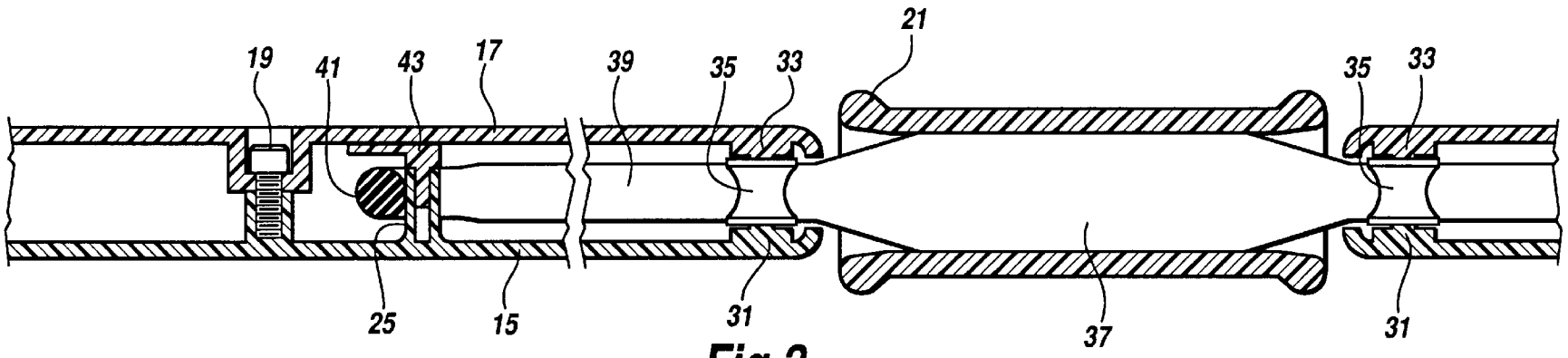
FIG. 3 is a partial cross-sectional side elevation thereof as seen along lines 3—3 in FIG. 2.

FIGS. 2 and 3 show the internal elements of the apparatus 11, with the handles 21 and 23 shown in cross-section. Eight anchor posts 25 are integrally formed with the frame first half 15 and provide means for anchoring elastic bands 27 and 29 to the frame 13, as will be discussed below. Eight roller posts 31 and 33 are integrally formed with the frame first half 15 and second half 17. A roller 35 is held in place on the roller posts 31 and 33 and can rotate thereon. The rollers 35 allow the inner elastic bands 27 to stretch outside the frame 13 without binding against the frame 13.

Four essentially identical elastic bands 27 and 29 are located about the frame 13, and provide the resistance to movement that exercises the user's muscles. A handle portion 37 of each of the bands 27 and 29 can be displaced from its unstressed, or rest position by applying force to the handle portion 37, thereby stretching the respective elastic band 27 and 29. The amount of displacement of the handle portion 37 per unit force applied to the handle portion 37 is called the spring rate, and is analogous to the spring rate of a coiled metal spring. The spring rate can be adjusted by varying the thickness of the elastic bands 27 and 29, and by using a material having a different modulus of elasticity. The apparatus 11 can be optimized for users by means of sets of elastic bands 27 and 29 having different springs rates. Users desiring a more strenuous workout would use bands 27 and 29 having a larger value of spring rate.

In the preferred embodiment, the material used to make the bands 27 and 29 is a member of the family of styrene-butadiene-styrene (SBS) elastomers, specifically being a styrene-diene-styrene copolymer having an ethylene-butylene midblock, with mineral oil and polyolefins added for improved properties. Some of these properties include a desirable values of the modulus of elasticity, and good memory, or the ability of the material to return repeatedly to its unstressed position without significant permanent deformation or change in the modulus of elasticity. Other elastic materials exhibiting these properties can be used, including but not limited to other elastomers and synthetic and natural rubbers.

The handle portion 37 of each of the bands 27 and 29 is made thick enough to provide a snug fit with one of the handles 21 and 23. On either side of the handle portion 37 is an anchoring portion 39 that terminates in a ring 41 adapted to mount on an anchor post 25. The anchoring portions 39 are sized to fit within the contour of the rollers 35. A clamp 43 is fastened to each anchor post 25 to retain the ring 41 on the post 25.

The portion of the frame 13 near each inner handle 21 is formed into an outer strut 45 offset from and parallel to the inner handle 21. The portion of the frame 13 near each outer handle 23 is likewise formed into an inner strut 47 offset from and parallel to the outer handle 23. The distance between an outer strut 43 and its nearby inner handle 21 is greater than the distance between each inner strut 47 and its nearby outer handle 23, but these distances, and their relative sizes, can be adjusted. The struts 45 and 47 are sized to provide a comfortable hand grip. The struts 45 and 47 can thus be used as additional gripping points, which increase the range of functionality of the device, as will now be discussed.

Identical slots 49 are formed in the frame 13 on each side of the outer handles 23. The slots 49 allow the outer elastic bands 29 to be stretched without binding against the frame 13. Bumpers 51 formed in the frame 13 adjoining the slots 49 also help prevent binding, and strengthen the frame 13 where the elastic bands 29 come in contact with the frame 13 during stretching.

The apparatus 11 can be used in a number of ways to exercise muscles in the arms, legs, chest, abdomen, back, and shoulders. The most direct method is to grasp the outer handles 23 and pull them apart, away from their respective inner struts 47, which simultaneously exercises muscles in the back, arms, and chest. The opposing sets of muscles can then be exercised by grasping the inner handles 21 and pressing them towards each other and away from the outer struts 45. The muscles in the hands can be exercised by grasping an inner handle 21 and its respective outer strut 45 in each hand, and compressing the handle 21 toward the strut 45. In this way, the apparatus 11 performs like the traditional metal spring type of hand grip exercisers. Another method of using the apparatus 11 consists of anchoring an outer handle 23 with a foot and pulling on the other handle 23. Yet another method of operation is contemplated, wherein the user attempts to twist the handles 21 or 23 perpendicular to the plane of the frame 13. Even more ways of operating the apparatus are contemplated, but the methods just discussed should adequately illustrate the versatility and utility of the apparatus 11 as a general purpose exercise apparatus.

The exercise apparatus of the invention has several advantages over the prior art. It has great versatility and can be used to work muscles throughout the body. It is easily transportable, and can be made aesthetically appealing. It can be optimized for a particular user by the use of different sets of elastic bands that provide varying degrees of resistance to being stretched. The exercise apparatus can be constructed simply and inexpensively, is extremely rugged and durable, and has no complicated moving parts.

The invention has been shown in only one embodiment. It should be apparent to those skilled in the art that the invention is not so limited, but is susceptible to various changes and modifications without departing from the spirit of the invention.

What is claimed is:

1. An exercise apparatus comprising:

an annular frame, further comprising a first half and a second half fastened together to form a hollow frame;

a plurality of elastic elements, each element having a handle portion adapted for gripping by a hand and anchoring portions adapted to attach to the frame; and anchoring means for attaching the elastic elements to the frame, the anchoring means and the anchoring portions of each elastic element being enclosed within the frame;

wherein the first frame half is removable to allow access to the anchoring means and the anchoring portions of the elastic elements, and wherein the hole defined in the center of the annular frame is substantially void when the elastic elements are in their rest positions, the hole also being sized to allow placing a user's head in the hole with adequate clearance to operate the apparatus.

2. An exercise apparatus as recited in claim 1, further comprising a plurality of handles, a handle being located on the handle portion of each elastic element.

3. A exercise apparatus as recited in claim 1, further comprising interchangeable sets of elastic bands, each band in a set having a spring rate substantially equivalent to that of the other bands in the set, each set having bands with spring rates different from the bands in another set of bands.

4. A exercise apparatus as recited in claim 1, wherein the anchoring means further comprises a plurality of anchor posts and a plurality of clamps, a clamp being removably attached to each anchor post.

5. A exercise apparatus as recited in claim 1, wherein the elastic elements are made of a material comprising a styrene-butadiene-styrene copolymer elastomer.

6. An exercise apparatus comprising:

an annular frame, further comprising a first half and a second half fastened together to form a hollow frame;

a plurality of elastic elements, each element having a handle portion adapted for gripping by a hand and anchoring portions adapted to attach to the frame;

a plurality of anchor posts attached to the frame for attaching the elastic elements to the frame; and a plurality of clamps, each clamp being removably attached to an anchor post, the anchor costs, the clamps, and the anchoring portions of each elastic band being enclosed within the frame;

wherein the first frame half is removable to allow access to the anchor posts, the clamps, and the anchoring portions of the elastic elements, and wherein the hole defined in the center of the annular frame is substantially void when the elastic elements are in their rest positions, the hole also being sized to allow placing a user's head in the hole with adequate clearance to operate the apparatus.

7. An exercise apparatus as recited in claim 6, further comprising a plurality of handles, a handle being located on the handle portion of each elastic element.

8. A exercise apparatus as recited in claim 6, further comprising interchangeable sets of elastic bands, each band in a set having a spring rate substantially equivalent to that of the other bands in the set, each set having bands with spring rates different from the bands in another set of bands.

9. A exercise apparatus as recited in claim 6, wherein the elastic elements are made of a material comprising a styrene-butadiene-styrene copolymer elastomer.

* * * * *